United States Patent [19]

Ghiassi

[11] Patent Number: 4,598,803

[45] Date of Patent: Jul. 8, 1986

[54] CONVENIENT AND COMPACT CARRY-ON, GARMENT BAG LUGGAGE ASSEMBLY

[76] Inventor: Mohssen Ghiassi, 12 Glen Alpine Rd., Piedmont, Calif. 94611

[21] Appl. No.: 656,786

[22] Filed: Oct. 1, 1984

[51] Int. Cl.[4] ..... A45C 3/00; A45C 13/00

[52] U.S. Cl. ..... 190/108; 190/102; 206/287.1

[58] Field of Search ..... 190/26, 100, 108, 110, 190/111; 206/286, 287, 287.1, 290, 291, 279; 150/52 E; D3/48, 71, 78

[56] References Cited

U.S. PATENT DOCUMENTS

| | | | |
|---|---|---|---|
| 2,086,895 | 7/1937 | Cart | 206/287.1 X |
| 2,453,663 | 11/1948 | Hinson | 190/100 |
| 2,496,128 | 1/1950 | Lifton | 206/287.1 X |
| 2,596,412 | 5/1952 | Kish, Jr. et al. | 206/287.1 X |
| 2,740,506 | 4/1956 | Davis | 206/287.1 |
| 2,774,450 | 12/1956 | Smallberg | 206/287.1 X |
| 3,221,848 | 12/1965 | O'Neil | 190/100 X |
| 3,273,678 | 9/1966 | Koret | 206/287 X |
| 3,542,170 | 11/1970 | Bialo | 206/287.1 X |
| 3,729,038 | 4/1973 | Ekeson | 190/110 X |
| 3,958,675 | 5/1976 | Rosenblum | 206/287.1 |
| 3,963,102 | 6/1976 | Carp | 190/108 |
| 4,081,061 | 3/1978 | Tucker | 190/108 |
| 4,170,282 | 10/1979 | Schwartzstein | 190/108 X |
| 4,206,835 | 6/1980 | Shapiro | 190/108 |
| 4,236,657 | 12/1980 | Brunton | 190/111 X |
| 4,420,068 | 12/1983 | Gerch | 190/108 X |
| 4,436,189 | 3/1984 | Baum | 190/108 |
| 4,489,829 | 12/1984 | Myers et al. | 206/287 |

FOREIGN PATENT DOCUMENTS

| | | | |
|---|---|---|---|
| 7900583 | 8/1979 | PCT Int'l Appl. | 190/108 |

*Primary Examiner*—William Price
*Assistant Examiner*—Sue A. Weaver
*Attorney, Agent, or Firm*—Leonard R. Cool

[57] ABSTRACT

A garment bag includes carry handles centrally disposed on the outer surface thereof and a carry strap that is snap connected to eyelets for shoulder carry. Eyelets are centrally disposed on opposite sides of the interior surface thereof and may be used for snap-hook attachment of a utility kit. A pair of bottom straps and a pair of side straps may be employed to embrace a carry-on bag that is designed to fit within the arc formed when the garment bag is folded over. The strap lengths are adjustable, and the shoulder strap used for the garment bag may be removed therefrom and attached to eyelets at each end of the carry-on bag, thus permitting shoulder carry of the carry-on bag. A compact carry-on luggage assembly is formed all of which may be tucked under a passenger seat or in an overhead compartment. Also, the units may be quickly disconnected one from the other as may be necessary.

7 Claims, 11 Drawing Figures

CONVENIENT AND COMPACT CARRY-ON, GARMENT BAG LUGGAGE ASSEMBLY

BACKGROUND OF THE INVENTION

1. Field of the Invention

This invention relates to luggage which is capable of being easily carried, and more particularly to a technique for readily assembling a number of different luggage items, such as a garment bag and a carry-on bag, into a compact unitary arrangement for ease of transport and for quick disassembly as required, for example, where the unitary arrangement is carried aboard an airplane. The arrangement can be taken apart so that the garment bag may be hung in a locker and the carry-on bag stowed under the seat.

2. Background Description

Light weight, soft-sided luggage is well known. Garment bags, carry-on bags and toilet kits are also well known in the trade. What has not been accomplished is to provide an arrangement whereby these three different items can be easily assembled into a compact luggage arrangement that combines all three elements into a single unit which is of reasonable size and portability, and which may be readily assembled and disassembled as circumstances require.

SUMMARY OF THE INVENTION

It is an object of this invention to provide a portable luggage assembly that includes a garment bag, carry-on bag and toilet kit.

It is another object of this invention to provide a portable luggage assembly in which the separate parts may be easily assembled and dissassembled.

It is a further object of this invention to provide a luggage assembly that may be readily carried aboard a commercial aircraft and, once aboard, easily separated so that the garment bag may be stowed in a locker and the carry-on stowed under the passenger seat.

It is yet another object of this invention to provide hanger connectors in said garment bag to simplify packing the garment bag.

Briefly, the invention comprises a carry-on bag, a toilet kit and a garment bag including inner and outer surfaces. Snap-hook means adapted for attaching said toilet kit across the center of said inner surface of said garment bag. Strap means including fastening means attached to the outer surface of said garment bag for enclosing said carry-on bag within the arc formed by said garment bag when the same is folded over said carry-on bag.

IN THE DRAWING

DESCRIPTION OF A PREFERRED EMBODIMENT OF THE INVENTION

Figure 1:
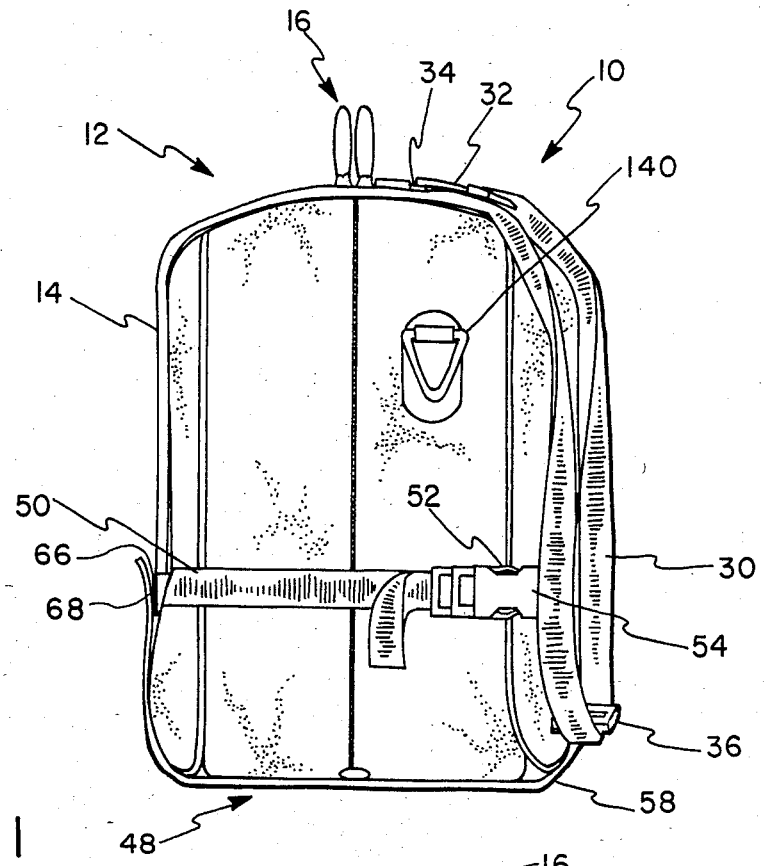
FIG. 1 is an elevation end view of the luggage assembly of the present invention when fully assembled.
Figure 2:
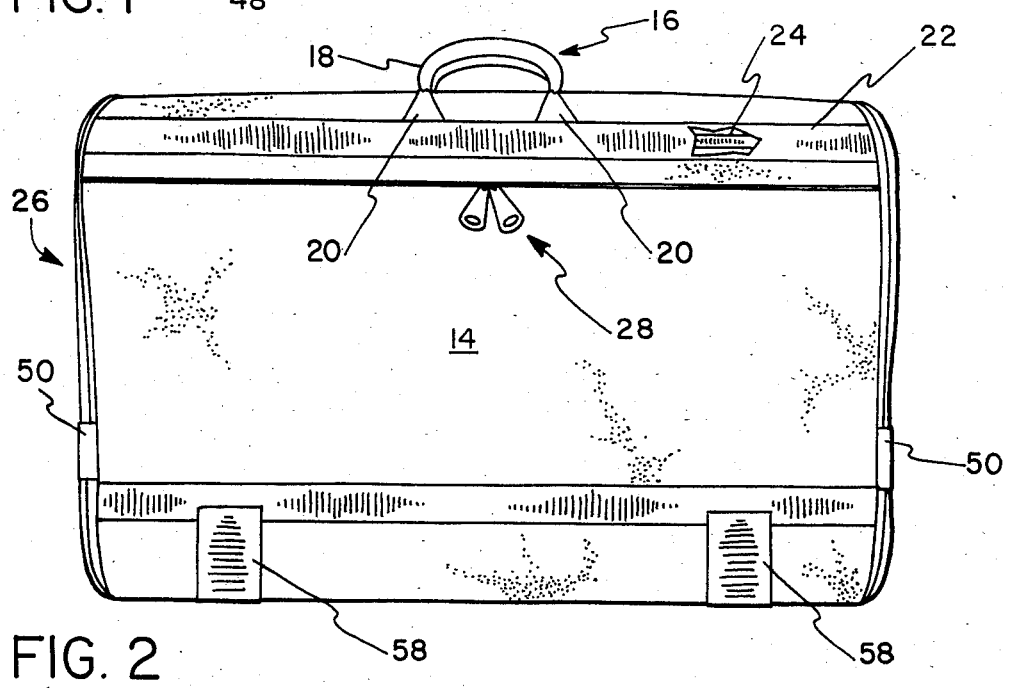
FIG. 2 is an elevation side view of the luggage assembly of the present invention when fully assembled.

Referring to FIGS. 1–4 a number of features of the invention may be comprehended. A luggage assembly 10 includes a garment bag 12 having an outer surface 14. A pair of carry handles 16 are centrally attached to said outer surface. Each said carry handle includes a padded grip portion 18 having a mounting web 20 attached to each end thereof. The mounting webs are sewn to the outer cover and held in position by transverse webs 22. Transverse webs 22 also hold stabilizing bars 24 in their assigned position. Also, formed in the outer surface 14 are side pockets 26 that are closed and opened by means of zippers 28. In addition, a carry strap 30 may be fastened to the eyelets 34 by means of snap-hooks 32 one of which is attached to each end of carry strap 30. As is well known for adjustable length straps, the other end is attached to a slide adjuster 36 from which the strap folds back along itself forming a loop. The other snap-hook is installed so as to be free to move along the loop so that the length may be adjusted as necessary. An eyelet 34 is attached adjacent to each outside edge of outer surface 14 along a transverse center line as shown. The length of carry strap 30 may be changed by moving slide aduster 36.

Figure 3:
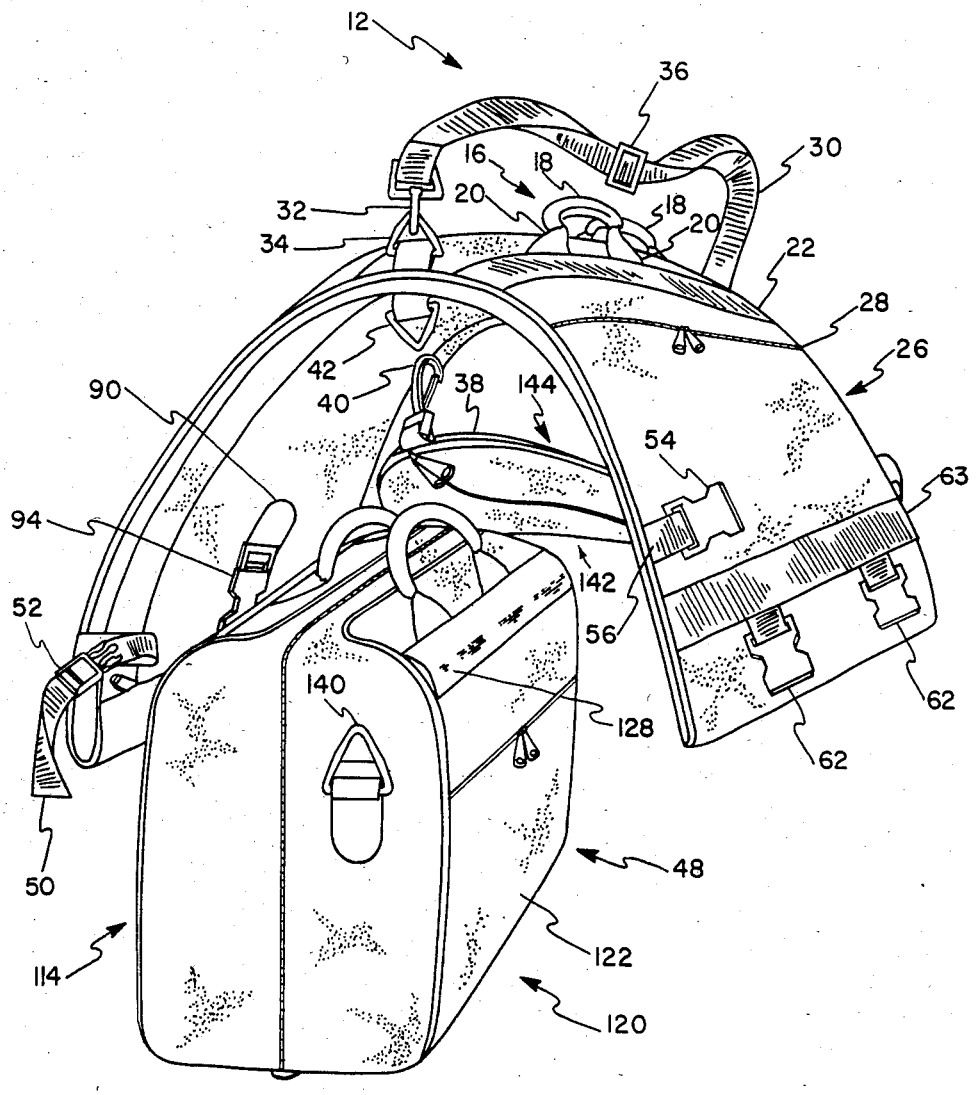
FIG. 3 is an exploded view of the luggage assembly illustrating in more detail the various parts of the luggage assembly, the snap-hook arrangement and the enclosing straps.
Figure 4:
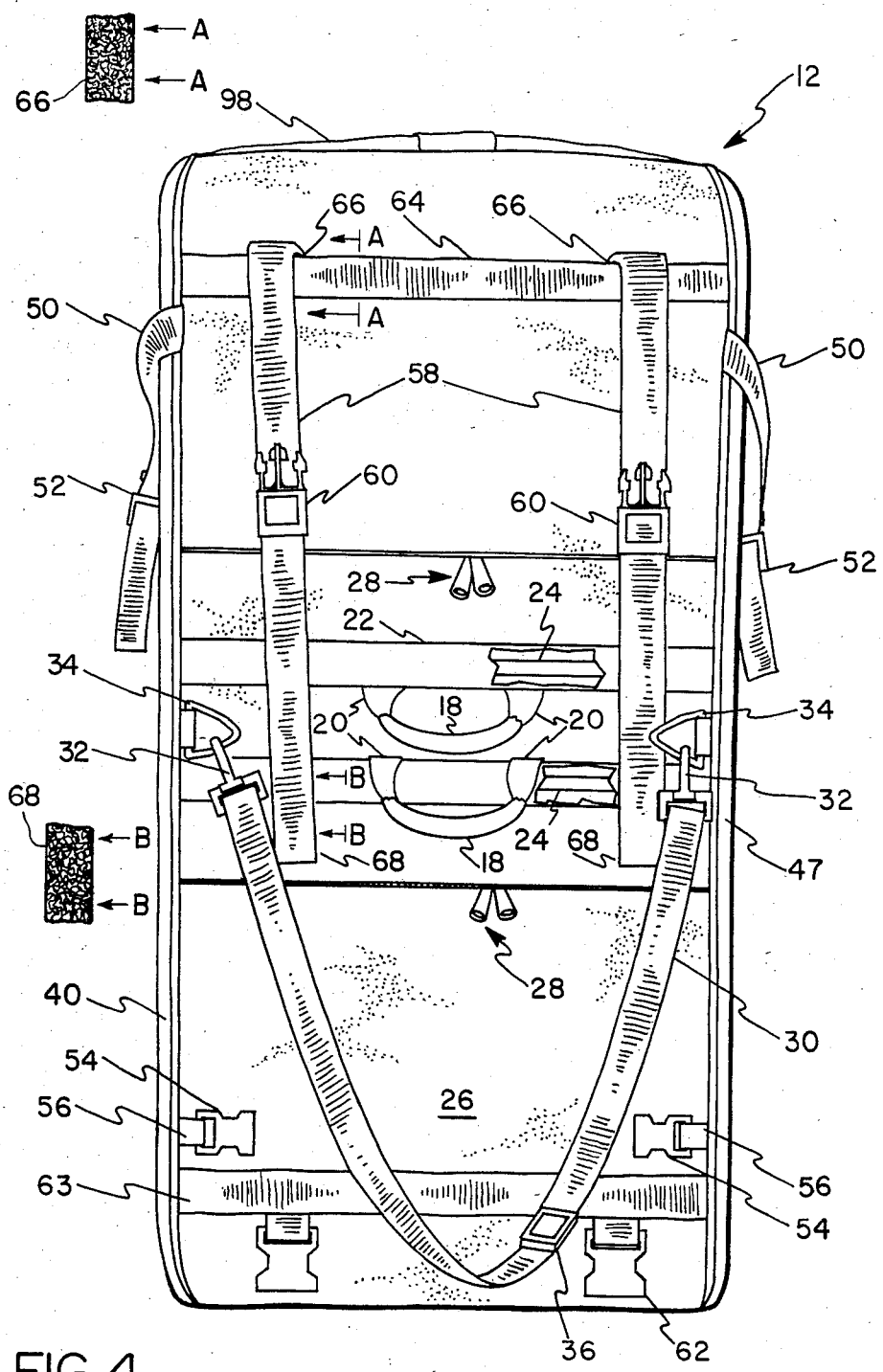
FIG. 4 is a plan view of the outer surface of the garment bag showing the carry handles, carry strap and the straps and fasteners used to enclose the carry-on bag.
Figure 5:
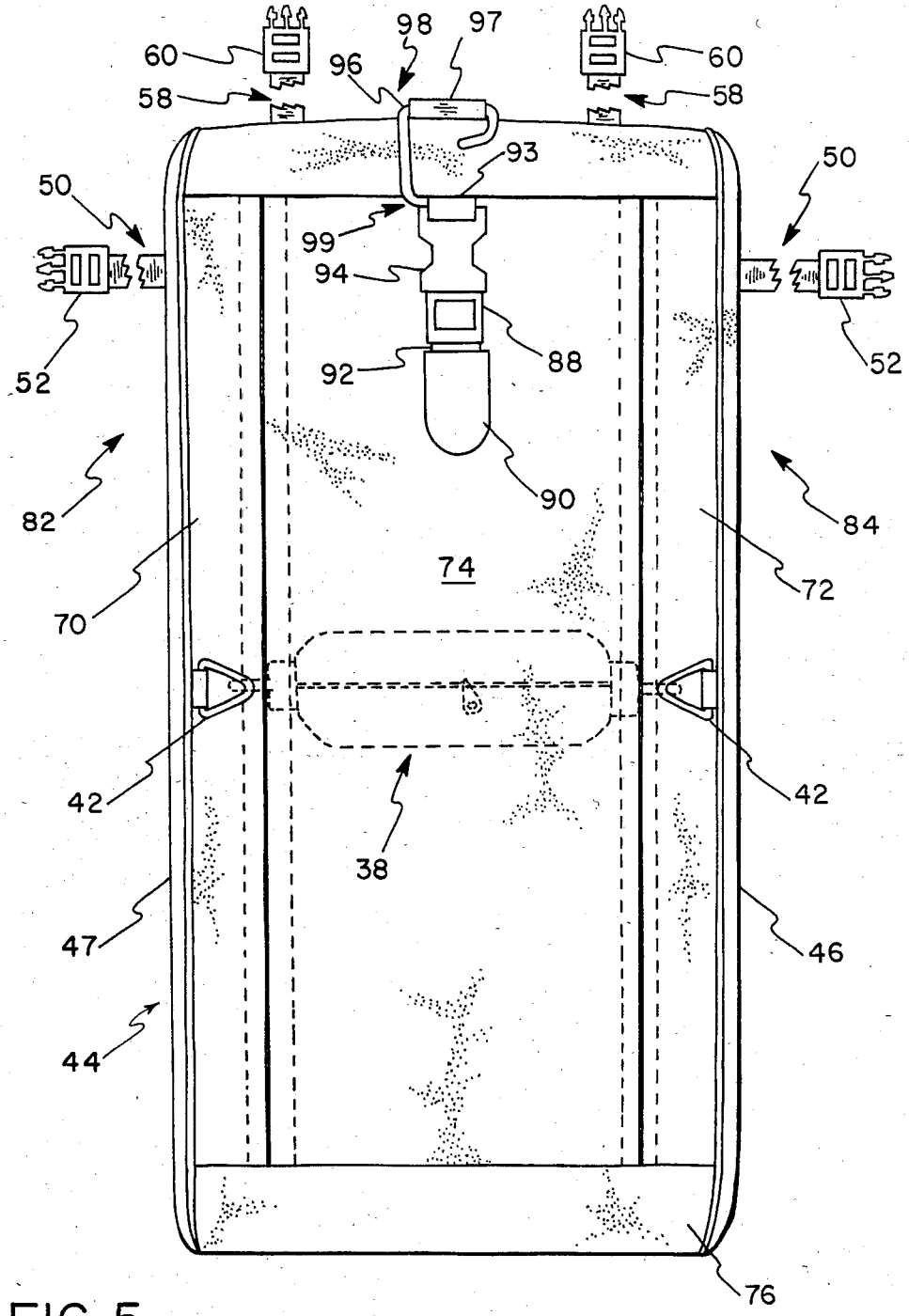
FIG. 5 is an elevation view of the inner surface of said garment bag illustrating the snap-hook arrangement for holding said toilet kit (shown in phantom) and the manner in which the hanging hook is secured when not in use.

To more clearly understand how the elements are connected together to form the luggage assembly as shown in FIG. 1, reference also should be made to FIGS. 3, 4 and 5. A utility kit 38 (shown in phantom in FIG. 5) is first connected transversely along the center line of the inner surface 44 of garment bag 12. Snap-hooks 40 are attached to each end of kit 38 and engage with eyelets 42 sewn to the seam between the inner surface and each side so as to be adjacent the inner surface 44 when the garment bag is folded over to enclose carry-on bag 48. Once the kit 40 is installed, the garment bag may be folded over the carry-on and the side and bottom straps put in place to hold the carry-on bag in the center of the arc thus formed. A pair of web side straps 50 each include a male fastener 52 that may be moved along the web strap to adjust the length thereof. These male fasteners engage with their female counterparts 54 which are attached to web 56, which is sewn into a seam adjacent the outer surface 14 near the bottom of the garment bag as shown. This holds the sides of the garment bag adjacent the sides of the carry-on bag, but would not provide the lift support required.

A pair of bottom straps 58 are used to close the open end (bottom) of the arc formed by the garment bag so as to provide for lifting for transport of the carry-on bag. Each strap includes a slidable male connector 60, which is designed to mate with a female connector 62. The straps 58 are attached to the outer surface 14 by a transverse web 64 at a point near the top end of the bag 12. The female connectors 62 are attached to said outer surface by a transverse web 63 at a point near the bottom end of bag 12. In order to prevent the excess length of straps 58 from hanging down during transport, a VELCRO strip 66 is attached to each strap adjacent the proximal end thereof and a matching strip 68 is attached to the distal end of said straps. Once the connectors are engaged, the distal end of straps 58 may be pulled to tighten the inner surface 44 against the exterior surface of carry-on 48 and the distal ends of said straps are then pressed against the VELCRO strips to hold them in position for transport.

Figure 6:
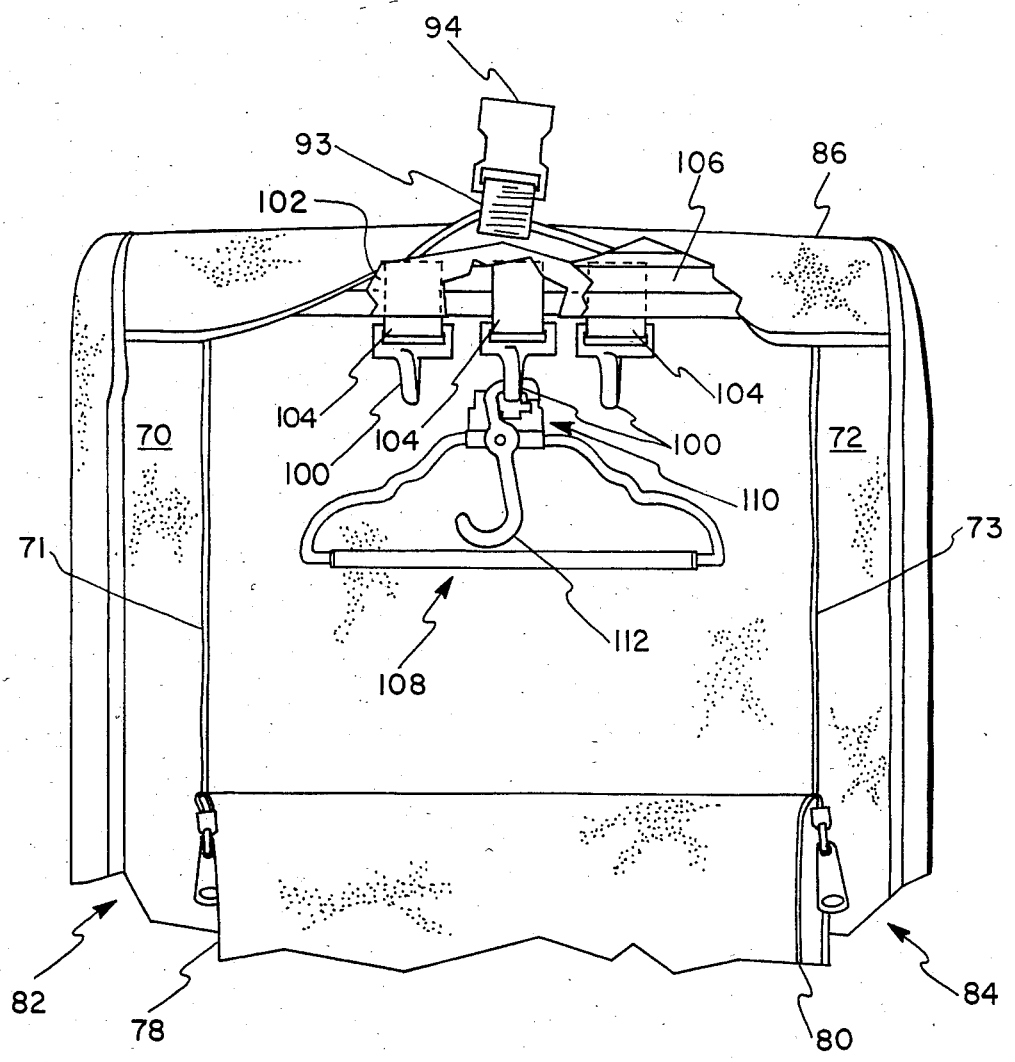
FIG. 6 is partially broken view of the inner surface and illustrates the interior of the garment bag when the zippers holding the inner panel in position have been partially pulled down and the panel folded back to reveal the garment eyelets to which the garment hangers are attached.
Figure 8:
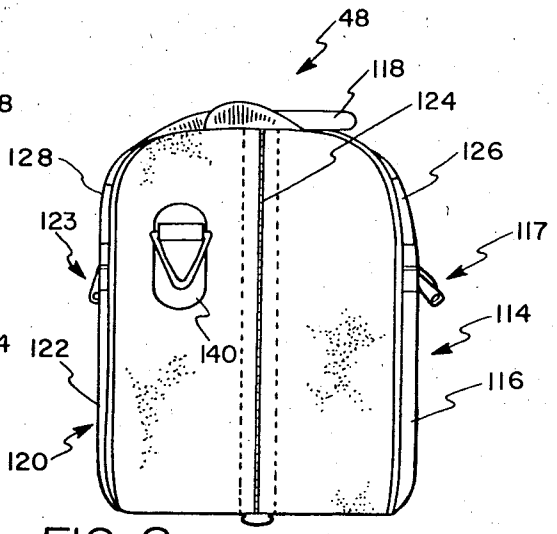
FIG. 8 is an end elevation view of said carry-on bag.
Figure 9:
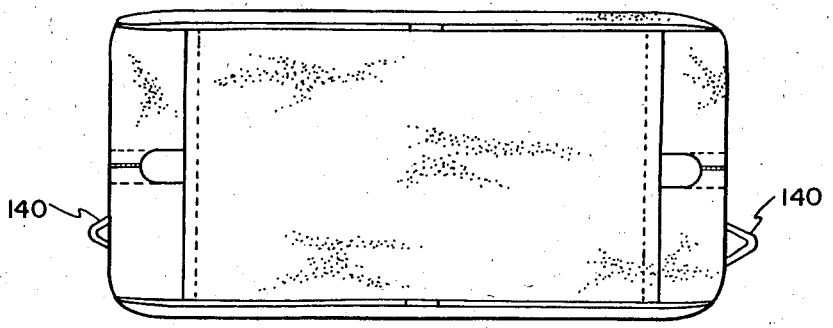
FIG. 9 is a bottom view of said carry-on bag.
Figure 7:
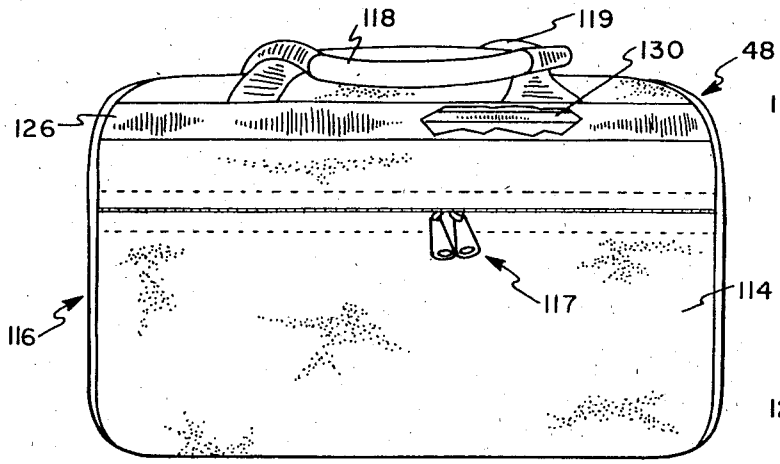
FIG. 7 is a side elevation view of said carry-on bag.

Referring now to FIGS. 5 and 6 some other novel features of the inner surface may be seen. Extending along the length of the sides 46 and 47 of garment bag 12 are left and right side strips 70 and 72, which are sewn at the outboard edges thereof to the respective left 47 and right 46 sides of the garment bag 12. A central panel 74 is fixedly attached to bottom strip 76. The side edges 78 and 80 of central panel 74 are slidably attached by means of slide fasteners 82 and 84, for example by means of a pair of zippers, to respective longitudinal edges of the inboard edges 71 and 73, respectively, of said side strips 70 and 72. The slide fasteners extend, as does the central panel 74 to a location near the top side 98 of garment bag 12. This places the closed panel 74 under flap 86, which provides a cover for the upper end of the garment bag. When closed, the central panel is centrally secured to the flap by the mating of male connector 88 with female connector 94. The male connector is attached to panel 74 by means of web 92 to which it is attached by a sewn loop. Web 92 being secured to panel 74 by a pad 90 which is sewn to the panel as shown. Female connector 94 is secured to flap 86 by web 93. A short piece of web such as 97 is formed in a loop about the hook-shaped end of hanging hook 96, and the web is sewn to a seam formed between the top end of outer surface 14 and the top edge of flap 86. The hanger end 99 of hook 96 is slipped under web 93 to hold it in place during transport.

Referring now to FIG. 6, a part of the interior of garment bag 12 may be seen. A plurality of hanger eyelets 100 are secured to small eyelet web straps 104 which are sewn to a transverse web strap 102 that is, in turn, sewn to the under side of the seam formed by the joining of outer surface 14 and flap 86. A stiffening rod 106 is held in position by strap 102 and provides the necessary rigidity to prevent crushing of hangers 108. The hangers are releasably connectable to the eyelets 100 by means of rotatable latching mechanisms 110 as is well known. When attached to the eyelets 100 the hanger hook 112 is positioned downward so as not to engage the top side of the bag. When the hanger latch is rotated the latch opens and the hanger may be removed from the eyelet. The latch may be rotated further in the same direction which then brings the hanging hook 112 to the top. This allows the clothes on the hanger to be hung on a closet rod, in a well known manner.

Referring now to FIGS. 7–10, the carry-on bag 48 is shown in more detail. Note that the right side 114 has an external pocket 116 that is closed by means of a slidable fasteners 117. Likewise, the left side 120 has an external pocket 122 that is closed by means of a slidable fastener 123. The carry-on bag is held in the closed condition by a pair of slideable fasteners. One such fastener is shown at 124 in FIG. 8. A pair of handles 118 and 119 are attached near the top edge of bag 48 by means of webbings 126 and 128, respectively. A pair of transverse stabilizing rods 130 and 132 are held in position, one in each of the sides, in channels formed by the use of the external webbings 126 and 128. The stabilizing rods 130 and 132 are shown in the partially broken sections of FIG. 7. These stabilizing rods provide the rigidity desired to obtain an easily handled bag. In addition, these stabilizing rods provide needed support when the carry-on bag is embraced by the garment bag to form a unitary luggage assembly.

Figure 10:
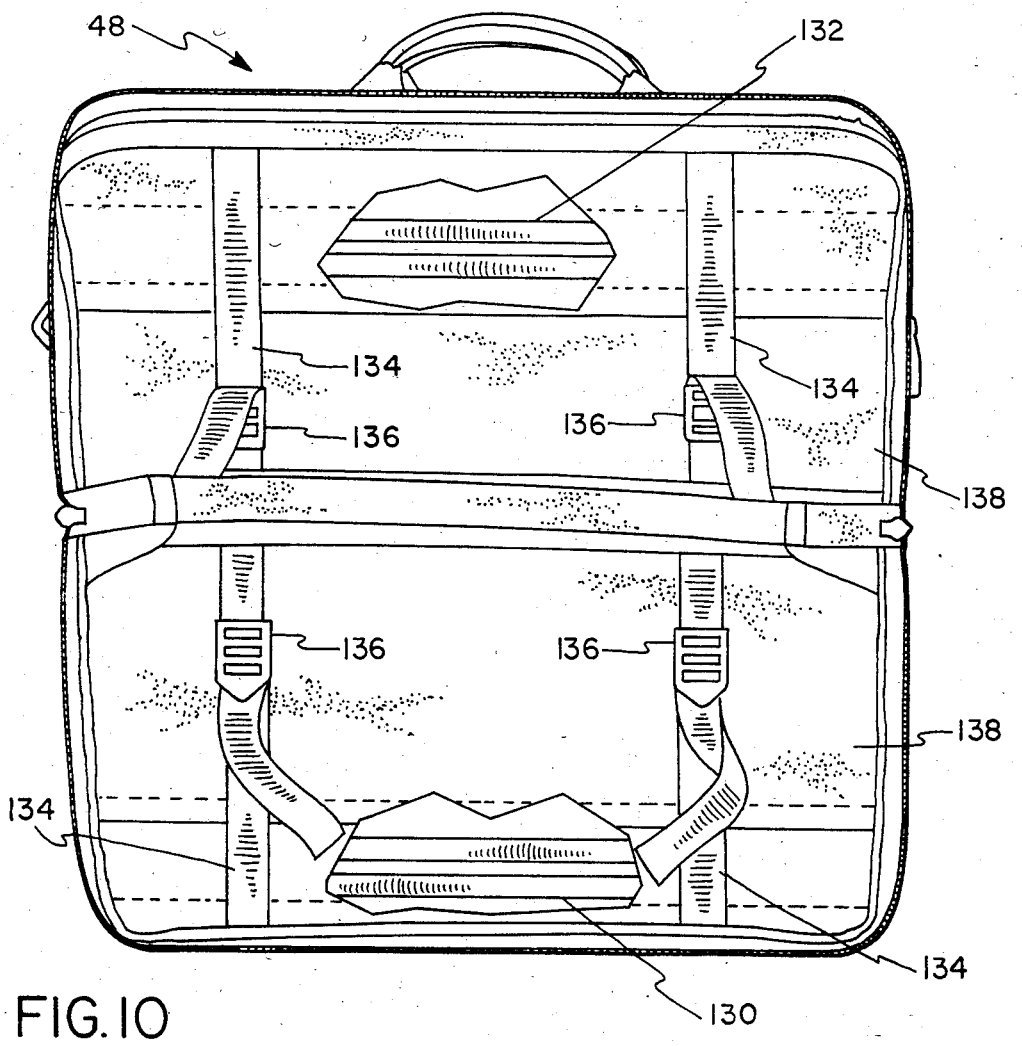
FIG. 10 is an interior view of said carry-on bag when in the open condition.

The carry-on bag 48 is opened by slidable fasteners as shown in particular in FIG. 10. As may be seen, the centrally located slidable fasteners which open the bag extend from the top of the bag to the bottom and thus provide two equal sections or pockets each of which may be equally filled. Straps 134 and associated slip buckle 136 permit adjustment of the strap length to hold in position the items stowed in either pocket. A lower portion of each pocket is lined as shown by lining 138 for better protection of the garments stowed therein. In the event the carry-on bag is to be used as a separate item, eyelets 140 are provided at either end. These eyelets will accept the snap-hooks of carry strap 30, and the strap can be adjusted to allow shoulder carry of the bag.

Figure 11:
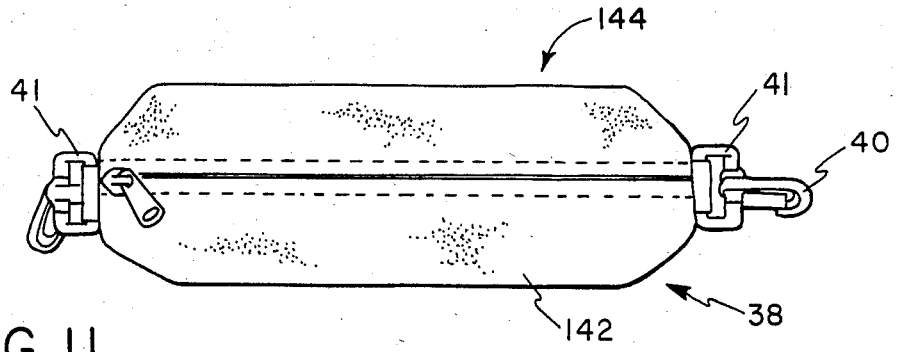
FIG. 11 is a plan view of said toilet kit showing the snap-hook connectors.

The utility kit 38 is shown in more detail in FIG. 11 and is a simple device having a top section 142 and a bottom section 144. The top section is slit into two halves which are coupled together by a slidable fastener when in the closed condition. The eyelets 41 of snap-hooks 40 are secured to opposite ends of the kit 38 by web loops that are secured in the seam between the top and bottom sections. As was discussed hereinabove, the kit 38 is attached to the inner surface 44 of garment bag 12 by snap-hooks 40 which are releasably connected eyelets 42, when it is in condition for transport.

In a preferred embodiment of the invention the elements of the luggage assembly were constructed using 1050 Denier Ballistic Nylon, 4000 L Nylon webbing having a 1½ inch width, top grain cowhide trim, fiberglass stabilizing bars, Parapak Nylon lining, Nylon coil zippers, Delrin hardware, Nylon thread, Ballistic Nylon welt and one inch ribbon for the binding. The entire assembly was sized so as to fit under the passenger seat or a commercial air liner or in the over head compartment. Thus, a very convenient, compact luggage assembly was formed for the traveler.

While the invention has been described hereinabove in terms of a preferred embodiment thereof, it is to be understood that those skilled in the art will comprehend the many modifications that may be made therein without departing from the spirit and scope of the invention.

What is claimed is:

1. A luggage arrangement that includes a number of parts which may be releasably assembled into a compact unitary arrangement, which comprises:

a utility kit;

a carry-on bag comprising a bottom, a pair of ends, a pair of sides and a top;

a garment bag made of flexible material, said garment bag having a width substantially the same as that of a side of said carry-on bag and a length, from bottom to top, which is substantially equal to the sum of the height of each side plus the width of said top of said carry-on bag so that said garment bag may be arranged to form an inverted U-shaped arc having an interior upper portion which may be formed to fit over said top of said carry-on bag and downwardly extending sides each having a length substantially equal to that of one of said pair of sides;

means for releasably connecting said utility kit across said interior upper portion; and strap means for releasably embracing said bottom of said carry-on bag so as to hold said carry-on bag within said U-shaped arc.

2. A luggage arrangement as set forth in claim 1 wherein said garment bag comprises:

a substantially rectangular box-like structure having a top, a bottom, left and right sidewalls each said side wall extending from said top to said bottom and between an outer and an inner exterior surface;

first handle means for hand carrying said garment bag, said handle means being centrally located in the outer exterior surface thereof;

first stabilizing means for providing a measure of rigidity to said garment bag said stabilizing means being located adjacent said first handle means;

first adjustable strap means attached to said outer exterior surface for carrying said garment bag;

hook means forming a part of said means for (attaching) releasably connecting which is used for connecting said utility kit substantially centrally of said inner exterior surface;

hanging hook means attached adjacent said top for hanging said garment bag when in a fully extended condition.

3. A luggage arrangement as set forth in claim 1 wherein said strap means comprises:

a pair of adjustable bottom straps attached near each side of said garment bag and near the top thereof;

a first pair of connectors adjustably connected to said bottom straps;

a second pair of connectors attached adjacent the bottom of said garment bag and adapted for mating engagement with said first pair of connectors, said pair of bottom straps providing support to said bottom of said carry-on bag when said connectors are matingly engaged and said straps adjusted to pull the interior portion of said garment bag tight against the sides of said carry-on bag;

a pair of adjustable end straps attached to the outer surface near the top of said garment bag;

a third pair of connectors adjustably connected to said end straps; and a fourth pair of connectors fixedly attached to the outer surface near said bottom of said garment bag, said end straps preventing lateral movement of said carry-on bag when the carry-on is enclosed within said U-shaped arc and said end straps are properly adjusted.

4. A luggage arrangement as set forth in claim 3 wherein said inner exterior surface of said garment bag comprises:

first and second narrow width longitudinal side portions being attached to and extending inwardly, respectively, from said left and right side wall along the full length of each said side wall and providing an inner left and an inner right edge;

a substantially rectangular central portion having a top edge, a bottom edge and left and right side edges, said central portion adapted to fit in the central opening formed by said longitudinal side portions, said bottom edge of said central portion being secured adjacent said bottom of said garment bag; and means for fastening or unfastening said left and right side edges of said central portion to or from, respectively, said inner left and right edges of said first and second portions, so that the central portion may be connected to one or both of said first and second portions or freed therefrom, whereby said garment bag may be placed in a closed or an open condition.

5. A luggage arrangement as set forth in claim 4 wherein said garment bag further comprises:

a narrow transverse extension of said top which forms along the top part of said inner exterior surface and is attached to the adjacent side walls and said first and second portions to provide a flap;

hanger means attached centrally of an interior wall of said top, for supporting clothes for transport;

a fastening strap attached centrally of said flap means, said strap having a male fastener secured to one end thereof; and a female fastener attached centrally of said central portion of said inner surface so as to be in alignment for mating engagement with said male fastener of said fastening strap when said inner cover is in the closed condition.

6. A luggage arrangement as set forth in claim 5 wherein said carry-on bag further comprises:

a pair of handles attached near the top by means of transverse webbings; and a pair of stabilizer rods held in fixed position by said transverse webbings, said stabilizer rods providing the rigidity desired to handle the bag as an item of luggage apart from said compact entity.

7. A luggage arrangement including a utility kit, carry-on bag and garment bag, the garment bag comprising a first pair of substantially rectangular panels made of a flexible material, said first pair of panels providing, respectively, inner and outer surfaces of said garment bag, a second pair of panels of flexible material, the edges of said first and second pair of panels being connected together so that said second pair of panels form the sides of said garment bag, a bottom and a top, said inner surface having a pair of longitudinally extending openings one adjacent each said side and each being provided with a closure, the utility kit having a width which is less than that of said garment bag and connector means for releaseably connecting the utility kit centrally of said inner panel, and said carry-on bag having a width substantially the same as that of said garment bag and said garment bag having a length such as to form a U-shaped arc over said carry-on bag whereby the bottom of said carry-on bag provides the bottom of said luggage arrangement when the parts are assembled together and said garment bag having side and end strap means for holding said carry-on bag in said U-shaped arc to form a compact unitary arrangement for transport.

* * * * *